United States Patent [19]

Kranich, II et al.

[11] Patent Number: 4,533,797

[45] Date of Patent: Aug. 6, 1985

[54] LOW VOLTAGE ROTARY TAP CHANGER

[75] Inventors: Neil J. Kranich, II, West Allis; Wallace E. Boivin, Jr., Waukesha, both of Wis.

[73] Assignee: ASEA Electric, Inc., Waukesha, Wis.

[21] Appl. No.: 618,264

[22] Filed: Jun. 7, 1984

[51] Int. Cl.[3] ..... H01H 21/62

[52] U.S. Cl. ..... 200/11 TC; 200/11 B

[58] Field of Search ..... 200/11 B, 11 G, 11 J, 200/11 TC, 17 R, 155 R, 243, 260, 273, 153 PA

[56] References Cited

U.S. PATENT DOCUMENTS

| | | | |
|---|---|---|---|
| 2,918,541 | 12/1959 | Waite | 200/273 X |
| 2,921,996 | 1/1960 | Dulude | 200/11 B |
| 3,177,307 | 4/1965 | Weber et al. | 200/11 B |
| 3,192,328 | 6/1965 | Wilson, Jr. | 200/11 B |
| 3,597,559 | 8/1971 | Van Riemskijk | 200/11 TC X |
| 4,412,116 | 10/1983 | Golub | 200/11 B X |

OTHER PUBLICATIONS

Luoma, R. W., IBM Tech. Disc. Bull., vol. 14, No. 3, Aug. 1971, "Geneva Mechanism", p. 797.

*Primary Examiner*—J. R. Scott

*Attorney, Agent, or Firm*—Ronald E. Barry

[57] ABSTRACT

A low voltage tap changer including a dielectric base fabricated from flat insulating sheet, a number of control decks mounted on the base, each deck including a corresponding number of cylindrical contacts, a continuous insulating shaft extending through each of the decks and being mounted for rotary motion with respect thereto, a number of pairs of curved contacts formed from flat copper sheet, mounted on the shaft and being positioned to engage the contacts, each of the pairs being self-aligning and biased to operatively engage the contacts and a Geneva drive assembly for rotating the shaft in a step-by-step manner and for locking the shaft in each position.

11 Claims, 5 Drawing Figures

LOW VOLTAGE ROTARY TAP CHANGER

BACKGROUND OF THE INVENTION

This invention relates to rotary switching apparatus for power transformers and specifically to de-energized rotary tap selecting switches. These switches are traditionally supplied for making minor adjustments to the primary winding ratio in order to compensate for line voltage variations related to physical distance from the point of power generation. Generally these adjustments are made at the time of installation and remain unchanged as long as the transformer remains at that site.

In known constructions, switches of the general class are immersed in transformer oil and are controlled from a single, externally mounted, operating mechanism coupled to them via a series of shafts and joints. In addition, the switches for each individual phase of the transformer are driven via additional couplings and shafts. When the operating mechanism travels through a fixed angular rotation to the next indicated tap position, the play in the plurality of joints can add up in a manner such that one or more of the switches may not complete the angular rotation necessary to make full engagement of the switch contacts. Depending upon the severity of the misalignment, there can be overheating or arcing both of which can cause catistrophic failure of the transformer.

The rotatable bridging devices customarily found in such switches are constructed in such a manner as to provide adequate contact area, mechanical and magnetic clamping forces and the ability for self-alignment due to wear in the contacts. The drawback of such mechanisms previously encountered is due to their complexity and the use of many accurately machined pieces required to obtain the desired attributes of a reliable contact assembly. Such construction is prohibitive in a low volume market where machining, inventory and labor costs must be carefully considered.

SUMMARY OF THE INVENTION

An object of the invention is to provide a rotary switch construction which overcomes the misalignment problem due to the inherent play found in operating systems.

Another object of the invention is to provide a self-aligning contact assembly comprised of a minimum number of machined parts, which embodies all the attributes of a quality tap changing switch.

It is a further object of this invention to repeatedly perform positive and accurate control positioning regardless of any inaccuracies in the manual operating system.

Still a further objective of the invention is to provide a rotary switch construction containing a minimum number of moving parts which are manufactured from readily available, stock materials on common machine shop equipment.

IN THE DRAWINGS

DESCRIPTION

Figure 2:
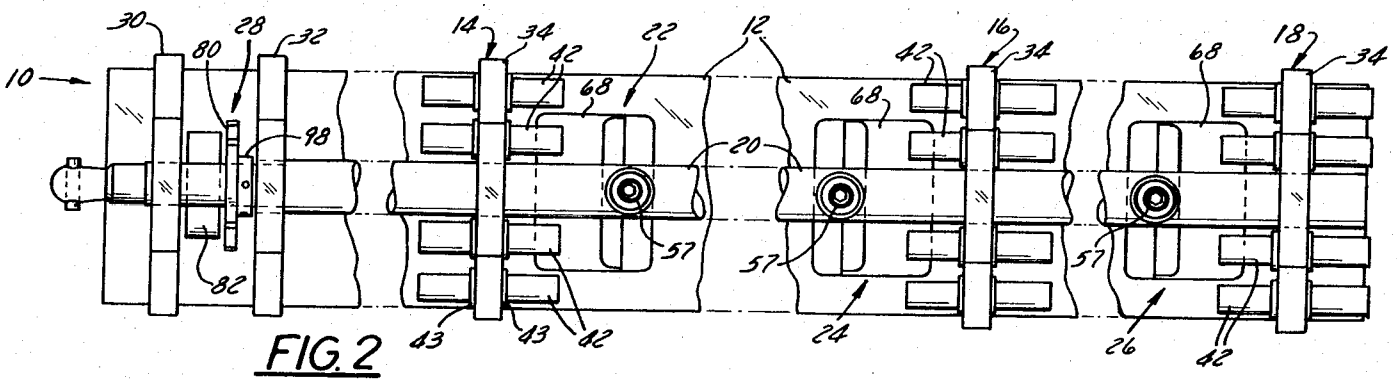
FIG. 2 is a top view of FIG. 1.
Figure 1:
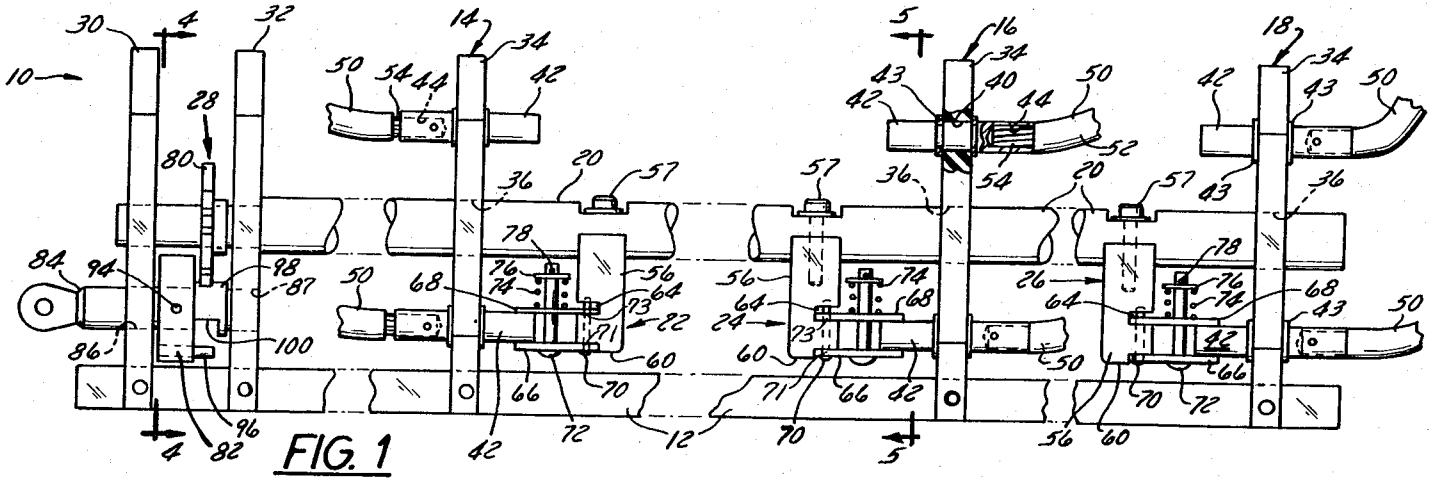
FIG. 1 is a side elevation view of the tap changer partly broken away to show the three decks.
Figure 4:
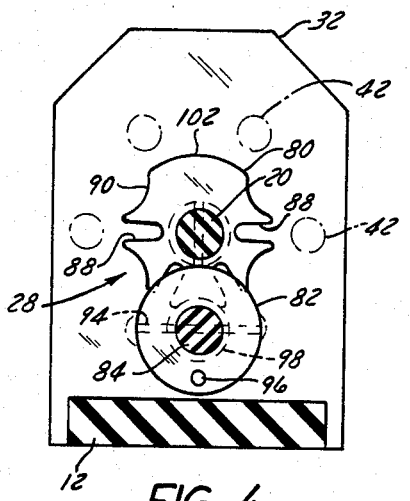
FIG. 4 is a view taken on line 4—4 of FIG. 1 showing the Geneva drive assembly.
Figure 5:
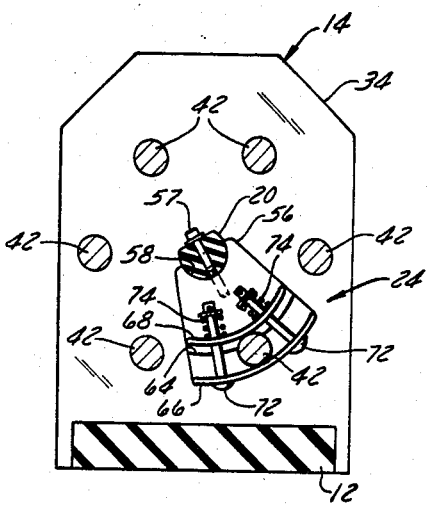
FIG. 5 is a view taken on line 5—5 of FIG. 1 showing the bridging contact.

The tap changer 10 generally includes a base plate 12 having three contact panels or decks 14, 16 and 18 mounted in a parallel spaced relation on the base plate 12. Each of the decks 14, 16 and 18 include six fixed contacts 42 arranged to provide five circuits for the tap changer. Means are provided on the decks 14, 16, 18 for selectively engaging two fixed contacts to thereby provide five circuits. Such means is in the form of three bridging contacts 22, 24 and 26 securely mounted on a continuously insulating shaft 20 for movement into engagement with the contacts 42 on the contact panels 14, 16, 18, respectively. The shaft 20 is rotated by means of a Geneva drive assembly 28 operatively connected to the shaft 20.

In this regard, the drive assembly 28 is supported between a pair of panels 30 and 32 mounted on the base plate 12. The shaft 20 can be rotated through predetermined angular distances in each direction of rotation by means of the Geneva drive assembly to thereby provide precise accuracy in moving and locating the bridging contacts with respect to the fixed contacts. The tap changer as described herein is commonly referred to as a 5-position, 3-deck tap changer, generally used for low voltage applications up to 69 KV and 350 KV BIL.

Figure 3:
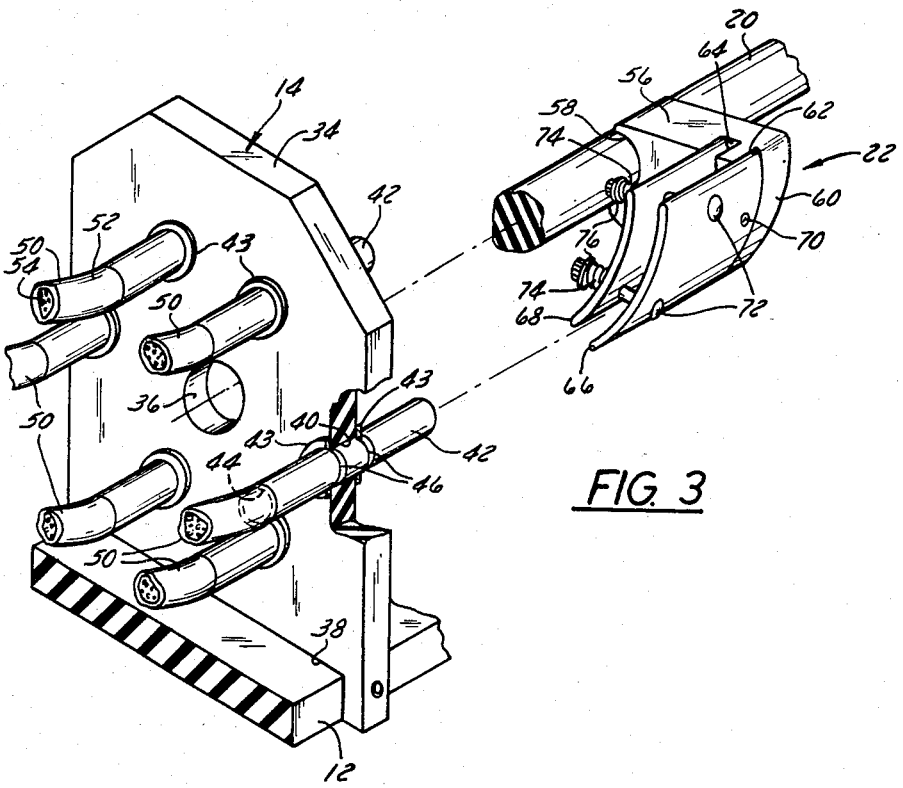
FIG. 3 is an exploded perspective view of one deck and the bridging contact.

Each deck 14, 16 and 18, as seen in FIG. 3, includes a panel 34 fabricated from flat insulating sheet having an axial bore 36 centrally located in the panel and a slot 38 cut in the base of the panel. Six contact holes 40 are circumferentially arranged at equal distances from the axis of the bore 36 and equally angularly spaced 60° apart.

Means are provided for connecting each deck to the corresponding transformer winding. Such means is in the form of crimped contacts 42 mounted in holes 40 in the panels 34. Each contact 42 is in the form of a cylindrical copper rod having a blind bore 44 at one end and a pair of annular grooves 46 intermediate the ends of the rod. The rod is positioned in one of the holes 40 and retained therein by means of retaining rings 43 seated in the grooves 46. The cables 50 are connected to the contacts 42 by stripping a portion of the insulation 52 from the end of the cable to expose the conductive member 54. The exposed conductive member 54 is inserted into the openings 44 and crimped therein to hold the cable in position. The contacts 42 are selectively interconnected in pairs by means of the bridging contact assembly 22.

In this regard each bridging contact assembly includes a contact support 56 having a semi-circular slot 58 at the inner end corresponding to the diameter of the shaft 20 and an arcuate outer surface 60. The contact support 56 is connected to the shaft 20 by means of a screw 57. A recess 62 is provided in the edge of the outer surface 60. An arcuate groove 64 spaced inwardly from the recess 62 is provided in the face of the contact support 56. Contact between adjacent contacts 42 is made by means of arcuate plates 66 and 68, fabricated from flat copper sheet, each having a radius of curvature corresponding to the radius from the axis of shaft 20 to the outer and inner surfaces of the contacts 42. The plate 66 is positioned within recess 62 in the outer edge of the contact support 56 by means of a clearance fit hole 71 in plate 66 and rolled pin 70 fixed in contact support 56. Similarly, plate 68 is positioned in groove 64 by means of a clearance fit hole 73 and rolled pin 70.

In this regard, it should be noted that the plates 66 and 68 are free to move on the rivets 72 and rolled pin 70 within the limits of the groove 64. The plates 66 and 68 are biased toward each other by means of a pair of springs 74 mounted on the ends of the rivets and held thereon by means of washers 76 and cotter pins 78. The distance between the plates is less than the diameter of the cylindrical contacts 42, as controlled by the space between recess 12 and groove 64, so that on rotation of the bridging contact assembly 22 the contacts 42 will cam plate 68 radially inwardly and plate 66 radially outwardly against the bias of the springs 74 to provide self-alignment and the mechanical force necessary for positive electrical contact with each of the contacts 42. Additional clamping force is obtained magnetically during high current surges due to the orientation of the plates 66 and 68. The rotational movement of the bridging contact assemblies 22 will also provide a brushing action against the outer surface of the contacts 42 to assure positive electrical contact between the plates 66, 68 and contacts 42.

The bridging contact assemblies 22 are moved in 60° steps by means of the Geneva drive assembly 28. The drive assembly includes a Geneva gear 80 mounted on the shaft 20 and a Geneva drive plate 82 mounted for rotary motion on the drive shaft 84 positioned in axial bores 86 and 88 provided in the panels 30 and 32, respectively. The Geneva gear 80 includes four radial slots 88 with arcuate surfaces 90 provided between the slots 88. The drive plate 82 is secured to the rod 84 by a pin 94. The Geneva gear is driven by means of a drive pin 96 provided on the outer circumference of the plate 82. A complete rotation of drive shaft 84 and the circular path of motion of the pin 96 into and out of the slots 88 in the gear 80 move the shaft 20 through 60° of angular motion.

Means are provided for locking the shaft 20 in a fixed position to assure accurate positioning of the bridging contact assemblies 22 with the contacts 42 between operations. Such means is in the form of a semi-circular hub 98 provided on the face of plate 82. The arcuate surface of the hub has a curvature corresponding to the diameter of the arcuate surfaces 90 provided on the Geneva gear 80. A slot 100 is provided in one side of the hub 98 to provide clearance for the rotary motion of the Geneva gear 80 as it is rotated by the pin on the drive plate 82. As the pin 96 clears the slot 88, the hub 98 will matingly engage the arcuate surface 90 between the slots 100 preventing further rotation of the gear 80. The Geneva gear 80 is designed to provide five active positions for the bridge contact assemblies 22 and is blocked from further movement beyond the five positions by means of the solid arcuate surface 102 provided on the periphery of the Geneva gear 80.

The embodiments of the invention in which an exclusive property or privilege is claimed, are defined as follows:

1. A rotary tap changing switch comprising,
- a base formed from a sheet of dielectric material,
- a contact deck formed from the same dielectric material mounted on said base,
- said deck including a bore and a number of rod contacts of equal diameter mounted in an equally spaced relation with respect to said bore,
- a shaft formed from a dielectric material and mounted for rotary motion in said bore,
- means on said shaft for selectively interconnecting two contacts at any one time,
- and means operatively connected to said shaft for rotating said shaft in a step-by-step manner through predetermined rotary distances to positively locate said interconnecting means with respect to said contacts whereby said interconnecting means is locked in said locations undisturbed by minor movements of the operating mechanism.

2. The switch according to claim 1 wherein said interconnecting means includes
- a pair of electrically conductive arcuate plates formed from copper sheet, positioned to engage both sides of said rod contacts.

3. The switch according to claim 1 or 2 wherein said rotating means includes
- a Geneva gear mounted on said shaft and having a number of radial slots and a drive member mounted for rotary motion on said base and having a drive pin positioned to move into and out of one of said slots to advance said shaft one step in each revolution of said drive member and lock means on said drive member positioned to engage said gear to lock said shaft in a fixed position.

4. A five position, three deck rotary tap changing switch comprising
- a base fabricated from flat insulating sheet,
- a number of contact decks mounted on said base in a parallel spaced relation,
- each deck including a bore and a number of fixed cable rod contacts mounted at equally spaced distances from each other and at equal radial distances from said bore,
- a shaft fabricated from standard insulating rod, extending through the bore in each of said decks,
- arcuate contact means corresponding to each of said decks and mounted on said shaft for engaging two of said cable contacts on each of said decks,
- Geneva gear drive means operatively connected to said shaft for rotating said arcuate contact means in a step by step manner to selectively connect said contact means to said cable contacts,
- said Geneva drive means includes
- a gear mounted on said shaft and having a number of radially extending slots and a drive plate mounted for rotary motion on said base,
- a drive pin mounted on said plate and being positioned to rotate into and out of one of said slots in each revolution of said plate to advance the shaft a predetermined angular distance.

5. The tap switch according to claim 4 wherein each of said contact means includes
- a pair of arcuate plates fabricated from standard sheet copper, spaced apart a distance less than the thickness of one of said fixed contacts.

6. The tap switch according to claim 5 wherein both of said plates are moveable with respect to each other and including
- means for biasing said plates toward each other to provide a self-aligning clamping action on the fixed contacts.

7. The tap switch according to claim 4 wherein said gear includes
- an arcuate surface between said pair of slots and said drive plate includes a semicircular hub which operatively engages each arcuate surface on said gear to lock the shaft in a fixed position when the drive pin is disengaged from the slots.

8. A low voltage rotary tap changing switch for a transformer comprising a base formed from an insulating material, a deck mounted on said base and formed from an insulating material, a number of cylindrical cable terminators mounted on said deck with the axis of said terminators located on a common cycle of revolution, a shaft formed from standard insulating rod and being mounted for rotary motion with respect to said deck, a self-aligning contact assembly secured to said shaft for selectively connecting two adjacent terminators and drive means operatively connected to said shaft for moving said shaft in a step-by-step sequence, said drive means including a drive member connected to advance said contact assembly one step in each full revolution of said drive member.

9. The tap switch according to claim 8 wherein the axes of said terminators are arranged in a parallel relation with respect to the axis of the shaft.

10. The switch according to claim 8 or 9 wherein said contact assembly includes two arcuate plates fabricated from copper sheet mounted in a spaced relation to engage the diametrically opposite sides of said terminators.

11. The tap switch according to claim 10 wherein said contact assembly includes means for biasing said plates into engagement with said terminators, whereby said plates provide the necessary mechanical and magnetic force and self-alignment properties necessary for good electrical contact.

* * * * *